US006645100B2

(12) United States Patent
Guenther et al.

(10) Patent No.: US 6,645,100 B2
(45) Date of Patent: Nov. 11, 2003

(54) SPORTS BALL WITH FLOATING COVER

(75) Inventors: Douglas G. Guenther, Wheaton, IL (US); Bradley L. Gaff, Newburgh, IN (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 10/097,987

(22) Filed: Mar. 14, 2002

(65) Prior Publication Data

US 2002/0091025 A1 Jul. 11, 2002

Related U.S. Application Data

(63) Continuation-in-part of application No. 09/738,741, filed on Dec. 16, 2000, now Pat. No. 6,413,177.

(51) Int. Cl.[7] ..... A63B 41/08
(52) U.S. Cl. ..... 473/605; 473/603
(58) Field of Search ..... 473/603, 604, 473/605, 609, 610, 599

(56) References Cited

U.S. PATENT DOCUMENTS 2,221,533 A * 11/1940 Voit et al. ..... 473/604
2,609,202 A * 9/1952 Winterbauer ..... 473/604
2,623,747 A * 12/1952 Crowley ..... 473/605
2,627,892 A * 2/1953 Fenton ..... 473/605
2,653,818 A * 9/1953 Tebbetts, Jr. et al. ..... 473/604
2,688,488 A * 9/1954 Crowley ..... 473/605
3,506,265 A * 4/1970 Yugi ..... 473/604

* cited by examiner

*Primary Examiner*—Steven Wong
(74) *Attorney, Agent, or Firm*—Terence P. O'Brien

(57) ABSTRACT

A sports ball includes an inflatable bladder, a plurality of first and second lining sheets, and a cover. The first lining sheets substantially cover the bladder to form a first lining. At least a portion of one first lining sheet overlaps at least a portion of another first lining sheet to define a first overlapped region. The first lining includes at least one first overlapped region. The second lining sheets substantially surround the first lining to form a second lining. At least a portion of one second lining sheet overlaps at least a portion of another sheet lining sheet to define a second overlapped region. The second lining includes at least one second overlapped region. The second lining is shifted with respect to the first lining to minimize overlapping of the first and second overlapped regions. The cover is coupled to and substantially surrounding the second lining.

32 Claims, 5 Drawing Sheets

SPORTS BALL WITH FLOATING COVER

RELATED U.S. APPLICATION DATA

The present invention is a continuation-in-part of U.S. patent application Ser. No. 09/738,741, entitled "Sports Ball With Floating Cover," filed on Dec. 16, 2000 by Guenther et al.

FIELD OF THE INVENTION

The present invention relates generally to sports balls or game balls. In particular, the present invention relates to a sports ball having a cover which is movable with respect to an interior bladder, and a game ball having at least two linings, which are orientated to minimize overlapping of lining material.

BACKGROUND OF THE INVENTION

Many sports balls and game balls include an inflatable bladder and a cover that surrounds the bladder. Such sports balls include, for example, volleyballs, basketballs, footballs, and soccer balls. Sports balls with inflatable bladders conventionally include a first lining over the bladder for reinforcing the bladder and for maintaining the shape of the bladder. For example, volleyballs have included a cloth lining, which surrounds the bladder. The cloth lining may be formed from a plurality of cloth sheets or panels, which are dipped in a latex adhesive or other adhesive and then applied to the outer surfaces of the inflated bladder. When the adhesive dries, the cloth panels are adhesively secured together and perhaps also adhesively secured to the bladder. The bladder and the lining form the carcass of the volleyball. The cover of the ball is formed from a plurality of panels of leather, synthetic leather, or other cover material which are adhesively secured to the lining. Volleyballs are described, for example, in U.S. Pat. Nos. 4,239,568 and 5,542,662.

Basketballs have included a wound liner layer, which is formed by winding thread or filament around the inflated bladder. The thread is conventionally nylon or similar material and may be dipped in latex glue or polyurethane adhesive before being wound over the bladder. Applying a layer of rubber over the wound bladder and molding the resulting structure under heat and pressure conventionally forms the carcass of a basketball. The cover is thereafter applied to the carcass. Basketballs are described, for example, in U.S. Pat. Nos. 5,310,178, 5,681,233, 5,931,752 and 6,024,661.

U.S. Pat. No. 4,239,568 describes a volleyball in which a layer of lubricant such as talc is interposed between the bladder and a first cloth layer. The lubricant prevents the cloth layer from sticking to the bladder. However, the manufacturing process requires applying the cloth layer to a hollow sphere, which is made from brittle material such as paraffin. The sphere is broken into pieces after the cloth layer is applied. The pieces of paraffin are removed through a slit in the cloth layer, and the bladder is inserted through the slit.

U.S. Pat. No. 5,542,662 describes a modified volleyball, which includes a bladder, and a thin rubber pouch which forms a covering layer over the bladder. The bladder is coated with an inorganic lubricant. The pouch is covered with latex-impregnated cloth and a cover layer.

The prior art volleyballs in which a layer of lubricant covers the bladder can be referred to as floating bladder volleyballs. The floating bladder is not adhered to the cloth layer, and the volleyball has a softer feel than other prior art balls in which both the bladder and the cover were adhesively secured to the cloth layer.

Existing game balls having a lining comprised of a number of sheets adhesively secured to each other are well known, and can include two or more linings wherein each lining is formed from a number of sheets. Such game balls with two or more linings, wherein each lining is formed from a number of overlapping sheets, have drawbacks. Each lining of this type includes a number of overlapped regions wherein portions of two or three separate sheets overlapping each other. Typically, the sheets are applied to the lined surface of the game ball in a manner that is consistent with the arrangement of outer cover panels of the game ball. For example, a conventional volleyball includes eighteen separate cover panels covering the ball. Typically, each lining would also be formed from twelve or eighteen sheets orientated in the approximate position of the cover panels. When two or more such linings are employed in the construction of a game ball, the double and triple overlapped portions of one lining often can be aligned or overlapped with the double and triple overlapped portions of a second lining. These regions of the game ball can response differently than other regions of the ball during manufacturing, particularly during curing, and often can lead to an out of round, misshapened, or otherwise defective appearance, when pressurized. These regions can also create hard spots or dead spots in the ball, which can react differently in use than other regions of the game ball and can result in a ball with an inconsistent and hard feel. These regions can also affect the rotation or the travel of the ball during use.

Thus, there is a need to develop a game ball having two or more linings that does not include regions of overlapped sections of one lining aligned with overlapped sections of a second lining. There is a need for a game ball including two or more linings that has a consistent softer feel. What is needed is a multi-lined game ball that consistently takes a desired shape and performs in a consistent manner during use. It would be advantageous to produce a multi-lined game ball without regions of aligned overlapped lining sections without requiring the implementation of costly and complex manufacturing steps.

SUMMARY OF THE INVENTION

The invention provides a volleyball or other sports ball with a floating cover rather than a floating bladder. Since the player feels the cover and not the bladder, better feel and performance is obtained if the cover can float relative to the carcass of the ball. The floating cover improves the dynamics of the ball and produces an even softer feel than a floating bladder.

The bladder is covered with an adhesive-impregnated lining that provides a load-carrying layer for retaining the shape of the bladder. The bladder and the attached cloth layer form the carcass of the ball. A layer of elastomeric material, which is not attached to the carcass, surrounds the carcass. The elastomeric layer and is movable relative to the carcass. A second lining is applied over the layer of elastomeric material. In a particularly preferred embodiment, the second lining is a layer of adhesive-impregnated cloth that facilitates adhesion of the cover to the elastomeric layer.

According to a principal aspect of the invention, a game ball includes an inflatable bladder, a plurality of first and second lining sheets, and a cover. The first lining sheets substantially cover the bladder to form a first lining. At least a portion of one first lining sheet overlaps at least a portion of another first lining sheet to define a first overlapped region. The first lining includes at least one first overlapped region. The second lining sheets substantially surround the first lining to form a second lining. At least a portion of one second lining sheet overlaps at least a portion of another sheet lining sheet to define a second overlapped region. The second lining includes at least one second overlapped region. The second lining is shifted with respect to the first lining to minimize overlapping of the first and second overlapped regions. The cover is coupled to and substantially surrounding the second lining.

According to another preferred aspect of the invention, a volleyball includes an inflatable bladder, a plurality of first and second lining sheets and a cover. The first lining sheets are arranged in a pattern generally resembling a conventional multi-panel volleyball cover and substantially cover the bladder to form a first lining. At least a portion of three first lining sheets overlap each other to form a first triple-layered region. The first lining includes at least one first triple-layered region. The second lining sheets are arranged in a pattern generally resembling the conventional volleyball cover pattern and substantially surround the first lining to form a second lining. At least a portion of three second lining sheets overlap each other to form a second triple-layered region. The second lining includes at least one second triple-layered region. The second lining is shifted with respect to the first lining such that the second triple-layered regions are generally not disposed over the first triple-layered regions. The cover is coupled to and substantially surrounds the second lining.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
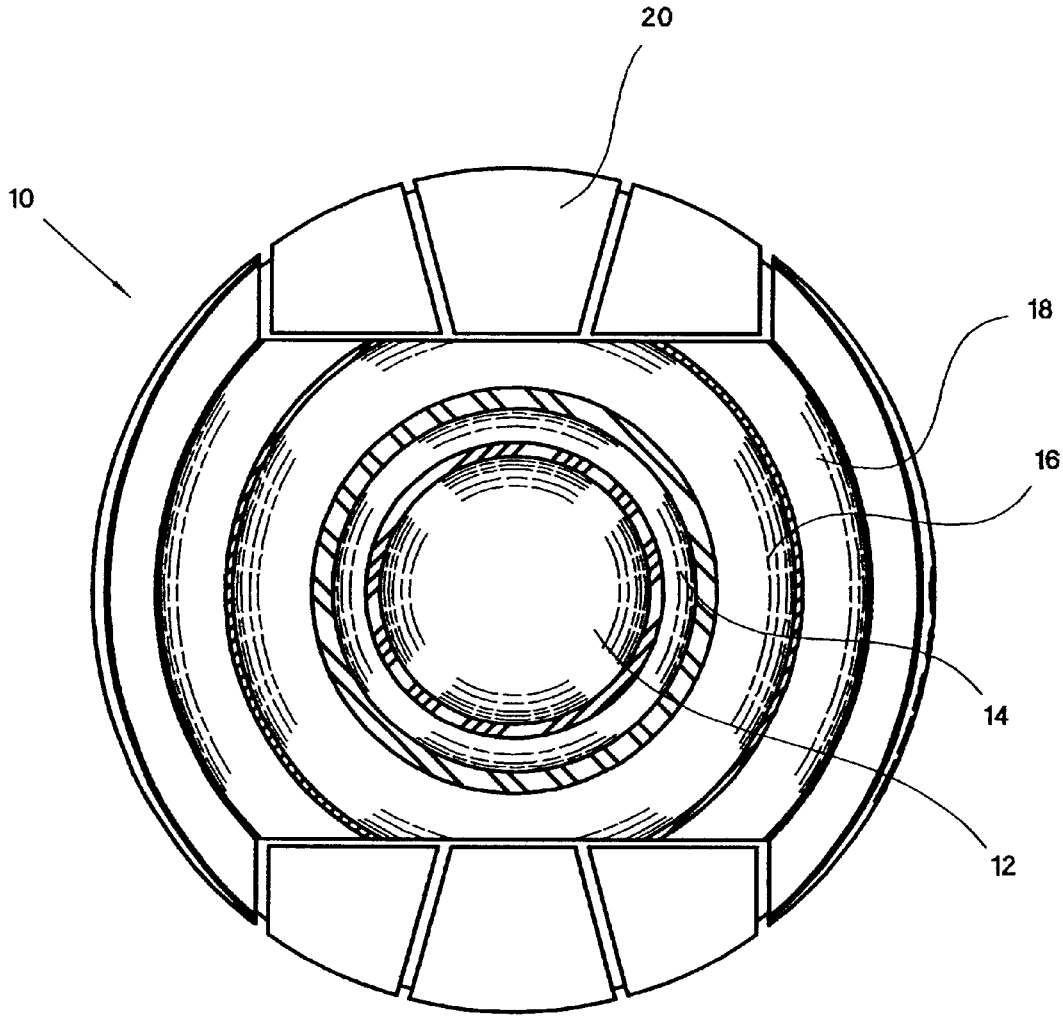
FIG. 1 is a top sectional view of a volleyball in accordance with a preferred embodiment of the present invention.

Referring to FIG. 1, a volleyball is indicated generally at 10. The volleyball 10 is one example of a sports ball or a game ball. The present application is directly applicable to other game balls, including, for example, basketballs, soccer balls, footballs, and rugby balls.

Figure 2:
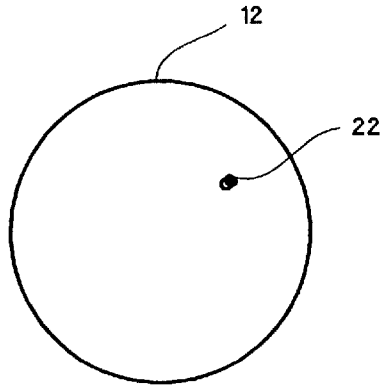
FIG. 2 is a perspective view of an inflated bladder of the volleyball of FIG. 1.

The volleyball 10 is a spherical inflatable object. The volleyball 10 preferably includes a bladder 12, a first lining 14, an elastomeric layer 16, a second lining 18 and a cover assembly 20. Referring to FIGS. 1 and 2, the bladder 12 is an inflatable air tube preferably having a spherical shape. The bladder 12 is disposed within the first lining 14, the elastomeric layer 16, the second lining 18 and the cover 20. The bladder 12 enables the volleyball 10 to retain a predetermined amount of air thereby achieving the desired air pressure within the ball 10. The bladder 12 also contributes to the firmness of the volleyball 10. The bladder 12 is made of an elastomeric material, preferably 100% butyl rubber. Alternatively, other materials can be used such as, for example, synthetic rubber, natural rubber or any other conventional bladder material. The bladder 12 includes a valve 22 that extends through the first lining 14, the elastomeric layer 16, the second lining 18 and the cover 20.

Figure 3:
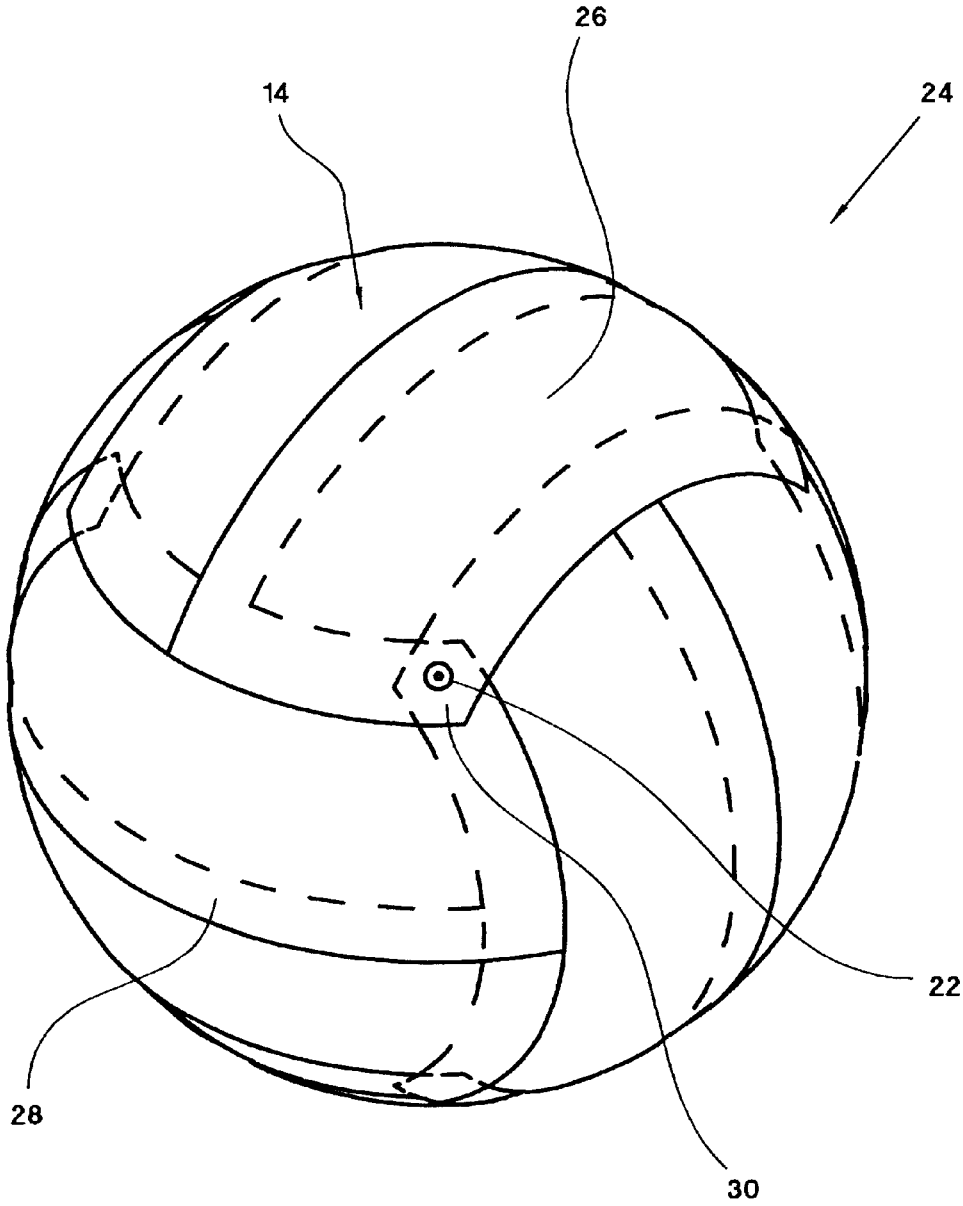
FIG. 3 is a top view of a carcass of the volleyball of FIG. 1.

Referring to FIG. 3, the bladder 12 is substantially covered with a first lining 14 to form a carcass 24. The first lining 14 is a thin layer of material comprised of a plurality of first sheets 26. Each first sheet 26 is a flexible thin member, preferably made of a cloth. Alternatively, the first sheet 26 can be made of other materials, such as, for example, woven fabrics, unwoven fabrics or other conventional flexible sheet material. The first sheet 26 typically includes an adhesive for attaching the first sheet 26 to adjacent sheets or to the underlying material (such as the bladder 12). In a preferred embodiment, each first sheet 26 is a layer of adhesive-impregnated cloth. In a particularly preferred embodiment, each first sheet 26 is a 60% polyester and 40% cotton cloth, which was immersed, in latex adhesive. The first lining 14 is applied to the bladder 12 while the bladder 12 is inflated so that the first lining 14 assumes a spherical shape.

The first lining 14 strengthens the bladder 12 and provides a load-carrying layer for retaining the shape of the bladder 12. The outer surface of the first lining 14, having a relatively low coefficient of friction, is conducive for enabling relative movement between the first lining 14 and the material surrounding the first lining 14.

In an alternative preferred embodiment, the first lining 14 can be arranged into six separate sections wherein each section includes one, two or three sheets 26, and wherein the sheets 26 collectively generally corresponds to the cover panel pattern of a conventional volleyball. In a preferred embodiment, the first lining 14 is comprised of twelve first sheets 26. The first sheets 26 are arranged in a pattern resembling the pattern of the outer cover panels of a conventional volleyball.

A portion of each first sheet 26 preferably overlaps, or is overlapped by at least one other first sheet 26. When fully applied to the bladder 12, the first lining 14 includes a plurality of double and triple overlapped (or layered) regions 28 and 30. The double overlapped regions 28 occur where a portion of one first sheet 26 overlaps a portion of one other first sheet 26. The triple overlapped regions 30 occur where a portion of three separate first sheets 26 overlap each other.

The first sheets 26 preferably overlap one or more other first sheets 26 by approximately 10 to 30 mm. In a particularly preferred embodiment, the first sheets 26 overlap each other by approximately 20 mm. Generally, if the sheets 26 are overlapped by less than 10 mm, the sheets 26 may be susceptible to becoming spaced apart or separating during manufacturing or pressurization of the game ball 10. Separation of the sheets 26 is undesirable because it can lead to the uncovered portion of the bladder 12 outwardly extending when pressurized through the separation in the first lining 14. Separation of the sheets 26 can result in a mis-shapened carcass 24 and ball 10. Conversely, overlapping the sheets 26 by an amount greater than approximately 30 mm leads to an excessive amount of overlapping over the surface of the bladder 12. However, in alternative embodiments the first sheets 26 can still be overlapped a lesser or greater amount.

In a particularly preferred embodiment, the first lining 14 includes six triple overlapped (or layered) regions 30 wherein one of the triple overlapped regions 30 is positioned on the bladder 12 at the valve 22 and another triple overlapped regions 30 is positioned opposite the valve 22 on the bladder 12. In alternative preferred embodiments, alternative numbers, and configurations, of first sheets 26 can be used to form the first lining 14.

Figure 4:
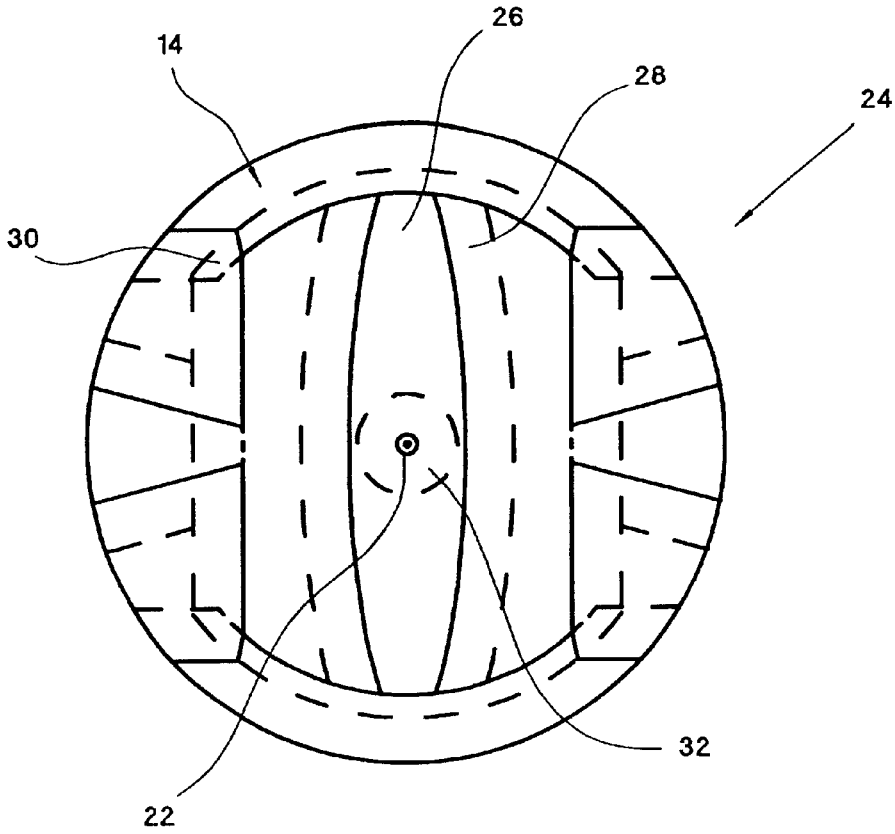
FIG. 4 is a top view of a carcass in accordance with an alternative preferred embodiment of the present invention.

Referring to FIG. 4 in another alternative configuration of the first lining 14 is shown wherein the first lining 14 is comprised of eighteen first sheets 26 arranged in a pattern resembling a conventional volleyball cover. In a particularly preferred embodiment, a generally circular patch 32 is placed around the valve 22.

Once the first sheets 26 are applied to the bladder 12, the carcass 24 is placed in a mold and molded under heat while the bladder 12 is pressurized. The carcass 24 is thereafter molded in a cooled mold. The first lining 14 is adhered to the bladder 12 by the latex adhesive. The bladder pressure is reduced to approximately 1 psi. to hold the shape of the carcass 24 while awaiting the next step in the manufacturing process.

Figure 5:
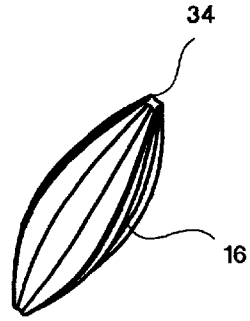
FIG. 5 is a perspective view of an elastomeric layer in accordance with a preferred embodiment of the present invention.
Figure 6:
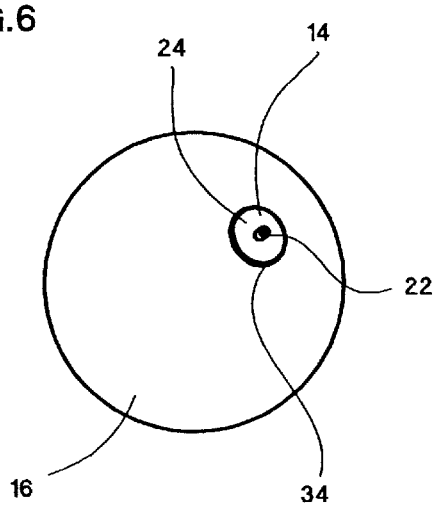
FIG. 6 is a perspective view of the elastomeric layer substantially surrounding the carcass of FIG. 3.

Referring to FIGS. 5 and 6, the carcass 24 is then deflated and inserted into the elastomeric layer 16 through an opening 34 within the elastomeric layer 16. The elastomeric layer 16 is preferably a one-piece, integral pouch, or bladder, sized to receive, and substantially surround, the carcass 24. The elastomeric layer 16 is made of a resilient, flexible material, preferably latex rubber. Alternatively, the elastomeric layer 16 can be formed from any suitable elastomeric material. The elastomeric layer 16 provides the ball 10 with a softer feel and improves the performance of the ball 10 during use by providing a layer of cushionable material to the ball 10. The elastomeric layer 16 is not attached to the first lining 14 and, therefore, can move relative to the first lining 14 during use. In an alternative preferred embodiment, a powder or a release agent can be applied between the carcass 24 and the elastomeric layer 16 to facilitate relative movement between the elastomeric layer 16 and the first lining 14. However, the elastomeric layer 16 can move relative to the carcass 24 during use, without the use of the powder or the release agent. In an alternative embodiment, the layer 16 can be made of two or more sections attached together to form the layer 16. In another alternative embodiment, the layer 16 can be made of a non-elastomeric material.

Figure 7:
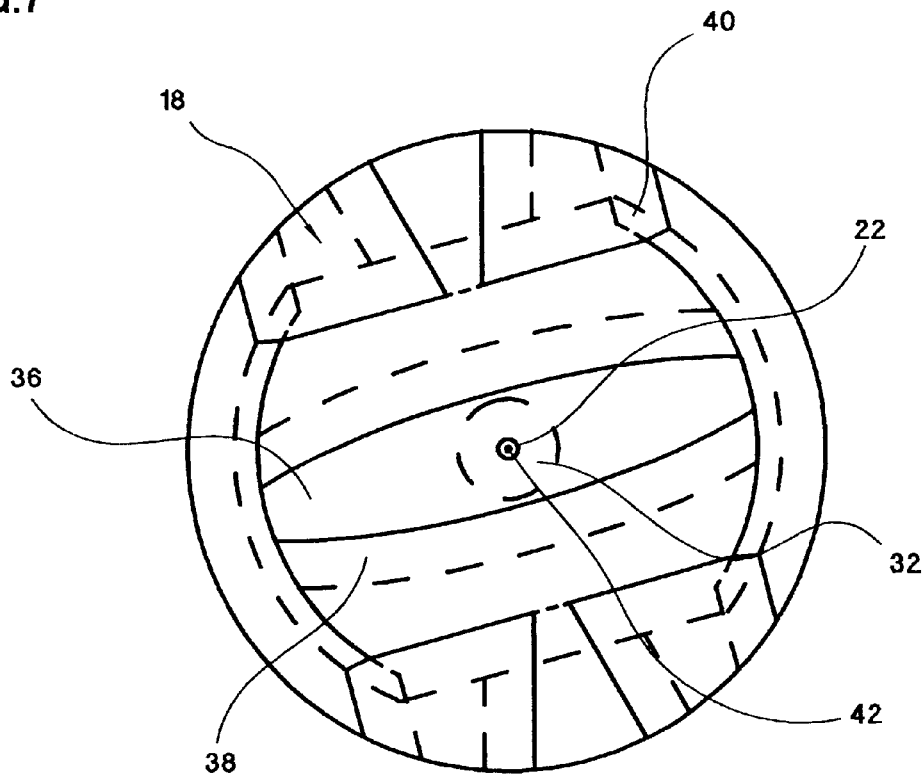
FIG. 7 is a top view of a second lining substantially surrounding the elastomeric layer of FIG. 6.

Referring to FIG. 7, the second lining 18 is shown substantially covering the elastomeric layer 16. Prior to installing the second lining 18, another patch 32 can be applied to the elastomeric layer 16 around the valve 22 to cover the opening 34 of the elastomeric layer 16. The second lining 18 is preferably formed from a plurality of second sheets 36. The second lining 18 and the second sheets 36 are substantially similar to the first lining 14 and the first sheets 26. Each second sheet 36 typically includes an adhesive for attaching the second sheet 36 to adjacent second sheets, and/or to one or both of the elastomeric layer 16 and the cover 20. In a preferred embodiment, each second sheet 36 is a layer of adhesive-impregnated cloth. In a particularly preferred embodiment, each second sheet 36 is a 60% polyester and 40% cotton cloth, which was immersed, in latex adhesive.

In a preferred embodiment, the second lining 18 is comprised of twelve or eighteen second sheets 36. A portion of each sheet 36 preferably overlaps, or is overlapped by at least one other second sheet 36, such that the elastomeric layer 16 is substantially covered by the load bearing second sheets 36. When fully applied to the second lining 18 includes a plurality of double and triple overlapped (or layered) sections 38 and 40. The double overlapped sections 38 occur where a portion of one second sheet 36 overlaps a portion of one other second sheet 36. The triple overlapped regions 40 occur where a portion of three separate second sheets 36 overlap each other. The second sheets 36 preferably overlap one or more other second sheet(s) 36 by approximately 10 to 30 mm. In a particularly preferred embodiment, the second sheets 36 overlap each other by approximately 20 mm. Alternatively, the second sheets 36 can be overlapped a lesser or greater amount. In alternative preferred embodiments, alternative numbers, and configurations, of second sheets 36 can be used to form the second lining 18.

The carcass 24 and the elastomeric layer 16 are inflated through the valve 22 and the second sheets 36 are applied to the elastomeric layer 16. In a preferred embodiment, the second lining 18 includes eighteen sheets which are arranged about the elastomeric layer 16 in a manner which resembles the outer cover panels of a conventional volleyball.

Preferably the second lining 18 is sufficiently shifted with respect to the first lining 14 such that none of the triple-overlapped (or layered) sections 40 of the second lining 18 are aligned with, positioned over, or overlapped with the triple-overlapped regions 30 of the first lining 14. In other words, at no point about the ball 10 do the combined layers of the first and second linings 14 and 18 reach six or more layers. In one preferred embodiment, the second lining 18 is shifted with respect to the first lining 14 such that the first and second linings 18, collectively, do not exceed four layers at any point on the ball 10. The triple overlapped regions 40, preferably numbering six, of the second lining 18 are preferably shifted and positioned over single layer portions of the first lining 14. In this configuration, the thickest or stiffest portions of the second lining 18 (the triple layered portions 40) are positioned over the thinnest most flexible portions (single layered portions of the first lining 14) of the first lining 14.

In an alternative preferred embodiment, the second lining 18 is shifted with respect to the first lining 14 such that the first and second linings 14 and 18, collectively, do not exceed five layers at any point on the ball 10. In a particularly preferred embodiment, less than five percent of the surface area of the bladder 12 includes five layers of the first and second linings 14 and 18, collectively.

Further, the second lining 18 is preferably shifted with respect to the first lining 14 such that overlapping of the double-overlapped sections 38 of the second lining 18 with the double-overlapped regions 28 of the first lining 14 is significantly reduced. In alternative preferred embodiments, the second lining 18 can be orientated or shifted in an alternative manner to reduce, minimize or eliminate overlapping of the double and triple overlapped sections 38 and 40 of the second lining 18 with the double and triple overlapped regions 28 and 30 of the first lining 14. For example, referring to FIGS. 4 and 7, in another preferred embodiment, the second lining 18 can be applied to the elastomeric layer 16 in a manner that is rotationally shifted relative to the first lining 14 about at least one axis extending through the ball 10. In one particularly preferred embodiment, the axis indicated at 42 extends through the ball 10 at the valve 22, and the second lining 18 is rotationally shifted with respect to the first lining 14 by at least 10 degrees about the axis 42. In alternative preferred embodiments, the second lining 18 can be shifted about a different axis extending through the ball 10 or multiple axes.

In another preferred embodiment, the first and second linings 14 and 18 are shifted with respect to each other in the following manner. One of the first sheets 26 of the first lining 14 is positioned about the valve 22 in a first position relative to the axis 42. The remaining first sheets 26 are applied to the ball 10 in a manner generally resembling the outer cover panel pattern of conventional volleyballs. The elastomeric layer 16 is applied over the first lining 14. Then, one of the second sheets 36 is placed onto the elastomeric layer 16 over, or about, the valve 22 in a second position with respect to the axis 42. The remaining second sheets 36 are then placed about, and substantially cover, the elastomeric layer 16 to also produce a pattern resembling the outer cover panel pattern of conventional volleyballs. The second position is preferably rotationally shifted by at least 20 degrees relative to the first position. In alternative embodiments, alternative numbers of sheets and configurations of sheets can be used, such as, for example, eight sheets corresponding to the eight panels of a conventional basketball.

By eliminating overlap or alignment of the triple-overlapped sections 40 with the triple-overlapped regions 30, the volleyball 10 takes a truer shape and the occurrence of mis-shapened or otherwise defective balls during manufacturing is reduced. Also, the existence of stiff, dead, or hard spots about the volleyball 10 are significantly reduced or eliminated thereby improving the feel and response of the ball during use. Further, the reduction of overlapping or alignment of the double-overlapped sections 38 with the double-overlapped regions 28 further improves the shape, ease of manufacture, feel and performance of the ball 10. Moreover, the shifting of the second lining 18 relative to the first lining 14 does not add to the manufacturing cost of the ball 10.

During manufacture, the latex adhesive of the second lining 18 is allowed to dry for about two hours, and the product is then hot molded and cold molded as previously described for the carcass 24. The pressure is then reduced to approximately 2 psi., and the weight, balance, size, and air leakage of the ball 10 are tested. Two coats of latex glue can then be brushed onto the second lining 18, allowing 20–30 minutes to pass between coats. The latex glue is preferably different than the latex adhesive, which was used to impregnate the first and second linings 14 ad 18. The product is then molded for approximately 30–40 seconds under room temperature to mold lamination lines on the second lining 18 for positioning a plurality of cover panels 44 which form a cover 20. The bladder 12 is pressurized at approximately 3 kg/cm$^2$ during this molding step.

Two coats of latex glue are then applied to the inside surfaces of the cover panels 44, and the cover panels 20 are applied to the second lining 18 to form the cover 20. The cover panels 44 may be formed from leather, synthetic leather, rubber, or any other conventional cover material. A volleyball conventionally includes eighteen cover panels 44.

The ball 10 then undergoes a final shaping/molding step at approximately 40–45 degrees C. and a pressure of approximately 2–4 kg/cm$^2$. The molding time is 3 minutes for leather-covered balls and 5 minutes for synthetic leather-covered balls.

Figure 8:
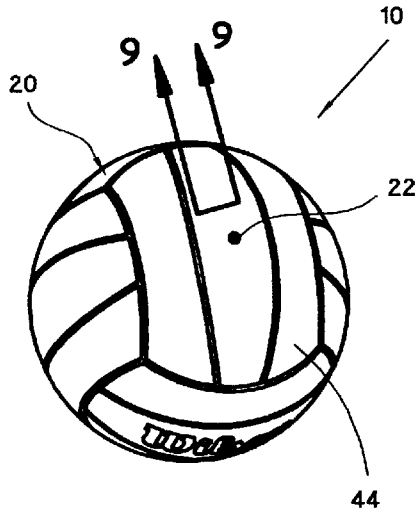
FIG. 8 is perspective view of the volleyball of FIG. 1.
Figure 9:
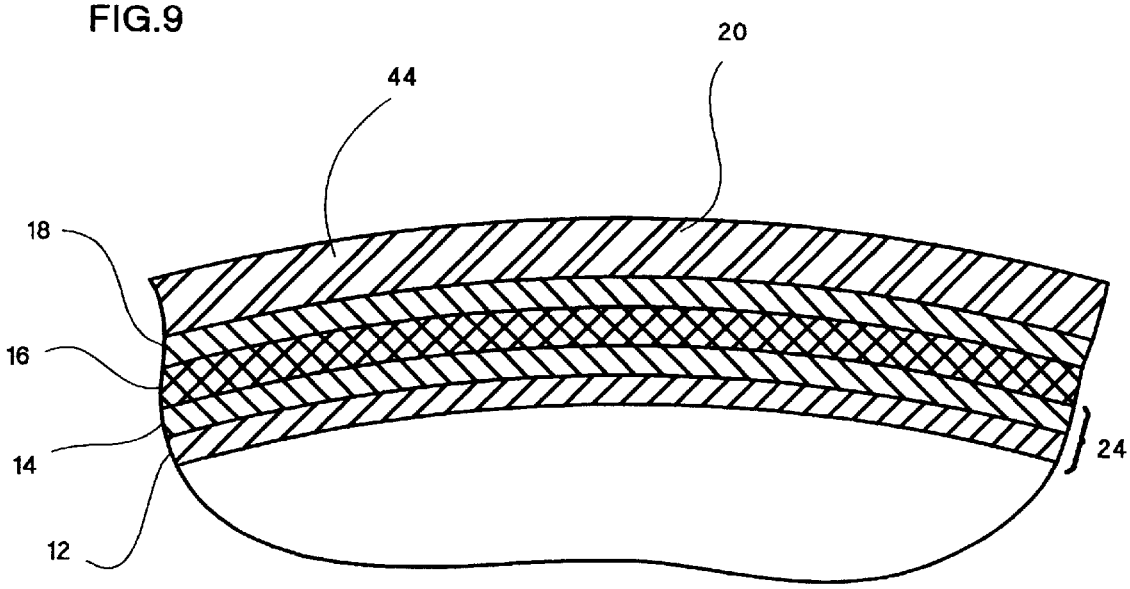
FIG. 9 is a fragmentary sectional view of the volleyball taken along line 9—9 of FIG. 8.

Referring to FIG. 8, a completed volleyball 10 in accordance with the present invention is illustrated. Referring to FIG. 9, the layers of the volleyball 10 are illustrated. The second lining 18 separates the cover 20 from the elastomeric layer and the carcass 24, which is formed by the bladder 12 and the first lining 14. The elastomeric layer 16 is not attached to the carcass 24 enabling the elastomeric layer 16, the second lining 18 and the cover 20 to move freely relative to the carcass 24. Volleyballs, which are formed in accordance with the invention, are faster and bounce higher than competitive volleyballs. When the ball impacts a player's hand, the cover can move relative to the carcass enabling the ball to stay in contact with the player's hand longer.

Figure 10:
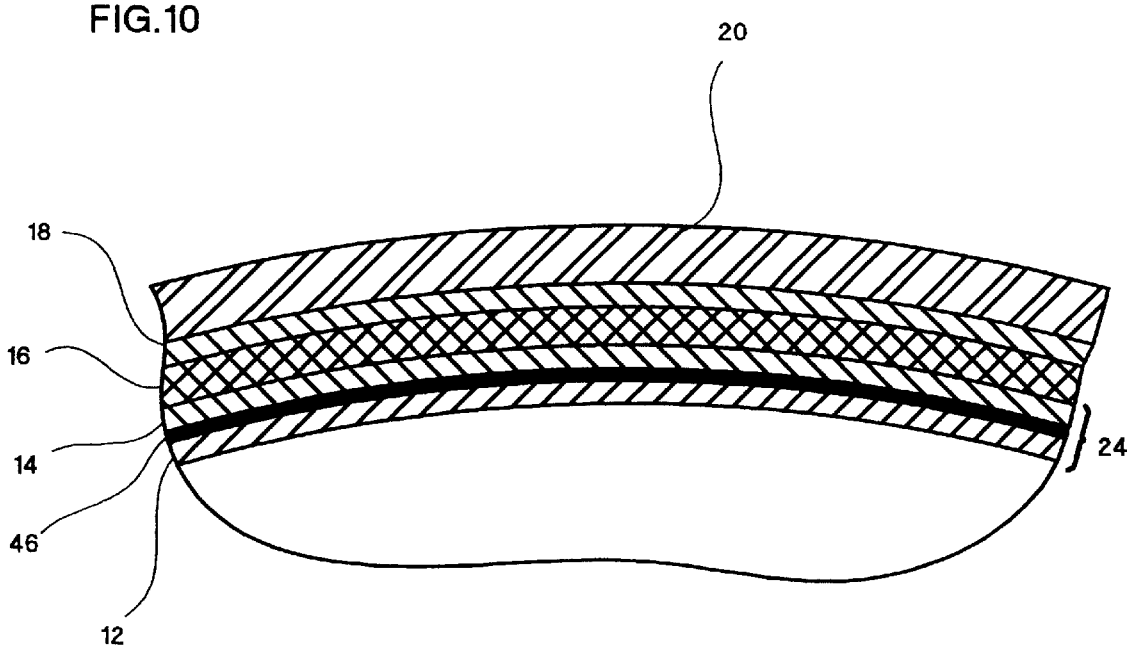
FIG. 10 is a fragmentary sectional view of the volleyball in accordance with an alternative embodiment of the present invention.

Referring to FIG. 10, in an alternative preferred embodiment, the volleyball 10 can also include a layer of windings 46, preferably disposed between the bladder 12 and the first lining 14. The layer of windings 14 includes one or more elongate threads, which are wound around the bladder 12 to form the layer of windings 14. The layer of windings 46 further reinforces the bladder 12 and further retains the spherical shape of the bladder 12. The threads are preferably formed of a high tensile strength material, such as nylon. In alternative embodiments, the thread can be a textile, a wire, or other conventional thread material.

In another alternative embodiment, the volleyball 10 can be formed without the elastomeric layer 16 and configured such that the second lining 18 is movable relative to the first lining 14.

In view of the wide variety of embodiments to which the principles of the invention can be applied, it should be apparent that the detailed embodiments are illustrative only and should not be taken as limiting the scope of the invention. Rather, the claimed invention includes all such modifications as may come within the scope of the following claims and equivalents thereto.

What is claimed is:

1. A game ball comprising:

an inflatable bladder;

a plurality of first lining sheets substantially covering the bladder to form a first lining, at least a portion of one first lining sheet overlapping at least a portion of another first lining sheet to define a first overlapped region, the first lining including at least one first overlapped region;

a non-adhesive intermediate layer substantially surrounding the first lining;

a plurality of second lining sheets substantially surrounding the intermediate layer to form a second lining, at least a portion of one second lining sheet overlapping at least a portion of another second lining sheet to define a second overlapped region, the second lining including at least one second overlapped region, the second lining being shifted with respect to the first lining to minimize overlapping of the first and second overlapped regions; and a cover coupled to and substantially surrounding the second lining.

2. The game ball of claim 1 wherein the intermediate layer is an elastomeric layer.

3. A game ball comprising:

an inflatable bladder;

a plurality of first lining sheets substantially covering the bladder to form a first lining, at least a portion of one first lining sheet overlapping at least a portion of another first lining sheet to define a first overlapped region, the first lining including at least one first overlapped region;

a plurality of second lining sheets substantially surrounding the first lining to form a second lining, at least a portion of one second lining sheet overlapping at least a portion of another second lining sheet to define a second overlapped region the second lining including at least one second overlapped region, the second lining being shifted with respect to the first lining to minimize overlapping of the first and second overlapped regions;

a cover coupled to and substantially surrounding the second lining; and an elastomeric layer disposed between the first and second linings, the elastomeric layer generally surrounding the first lining the elastomeric layer being movable with respect to the first lining.

4. The game ball of claim 3 wherein the elastomeric layer is a one-piece bladder.

5. The game ball of claim 3 wherein the second lining is secured to the elastomeric layer.

6. The game ball of claim 3, wherein one of the first sheets extends over or about a location point on the bladder in a first position, wherein one of the second sheets extends over the location point in a second position, and wherein the second position is rotated, about an axis outwardly extending from the location point and, with respect to the first position.

7. The game ball of claim 6 wherein the second position is rotated by at least 20 degrees about the axis and with respect to the first position.

8. The game ball of claim 7 wherein the bladder includes a valve positioned at the location point.

9. The game ball of claim 3 wherein the first and second linings are arranged in a pattern resembling a conventional volleyball cover.

10. The game ball of claim 3, wherein in at least one location on the first lining at least a portion of three first sheets overlap each other to form a first triple layered section, and wherein in at least one location on the second lining at least a portion of three second sheets overlap each other to form a second triple layered section.

11. The game ball of claim 10, wherein the second lining is shifted with respect to the first lining such that the second triple layered sections of the second lining are not disposed over the first triple layered sections of the first lining.

12. The game ball of claim 10, wherein in at least one location on the first lining at least a portion of two first sheets overlap each other to form a first double layered section, and wherein the second lining is shifted with respect to the first lining such that the second triple layered sections of the second lining are not disposed over either the first double layered sections or the first triple layered sections of the first lining.

13. The game ball of claim 3, wherein the first and second linings are arranged about the ball such that the collective layering of the first and second linings at any location about the ball is four layers or less.

14. The game ball of claim 3, wherein the first and second linings are arranged about the ball such that the collective layering of the first and second linings at any location about the ball is five layers or less.

15. The game ball of claim 1, further comprising a wound lining layer surrounding the bladder, and wherein the wound lining layer is disposed beneath the first lining.

16. A volleyball comprising:

an inflatable bladder;

a plurality of first lining sheets, arranged in a pattern generally resembling a conventional multi-panel volleyball cover and, substantially covering the bladder to form a first lining, at least a portion of three first lining sheets overlapping each other to form a first triple-layered region, the first lining including at least one first triple-layered region;

a plurality of second lining sheets, arranged in a pattern generally resembling the conventional volleyball cover pattern and, substantially surrounding the first lining to form a second lining, at least a portion of three second lining sheets overlapping each other to form a second triple-layered region, the second lining including at least one second triple-layered region, the second lining being shifted with respect to the first lining such that the second triple-layered regions are generally not disposed over the first triple-layered regions; and a cover coupled to and substantially surrounding the second lining.

17. The volleyball ball of claim 16 further comprising an elastomeric layer disposed between the first and second linings, and wherein the elastomeric layer generally surrounds the first lining.

18. The volleyball ball of claim 17 wherein the elastomeric layer is movable with respect to the first lining.

19. The volleyball of claim 18 wherein the second lining is secured to the elastomeric layer.

20. The volleyball of claim 16, wherein in at least one location on the first lining at least a portion of two first sheets overlap each other to form a first double layered section, and wherein the second lining is shifted with respect to the first lining such that the second triple layered sections of the second lining are not disposed over either the first double layered sections or the first triple layered sections of the first lining.

21. The volleyball of claim 16, wherein the first and second linings are arranged about the ball such that the collective layering of the first and second linings does not exceed four layers.

22. The volleyball of claim 16, wherein the first and second linings are arranged about the ball such that the collective layering of the first and second linings does not exceed five layers.

23. The volleyball of claim 16, wherein the second lining is rotationally shifted, about at least one axis extending though the ball and, with respect to the first lining.

24. The volleyball of claim 23 wherein the second lining is rotated by at least 20 degrees about the axis.

25. The volleyball of claim 16 wherein the first lining comprises six to eighteen first lining sheets.

26. The volleyball of claim 16 wherein the second lining comprises six to eighteen second lining sheets.

27. The game ball of claim 1, wherein the intermediate layer is substantially non-fixedly secured to the first linings and capable of moving relative to the first lining.

28. The game ball of claim 1, wherein the intermediate layer is a one piece pouch.

29. The game ball of claim 1 wherein the second lining is secured to the intermediate layer.

30. The game ball of claim 1 wherein the first and second linings are arranged in a pattern resembling a conventional volleyball cover.

31. The game ball of claim 1, wherein the first and second linings are arranged about the ball such that the collective layering of the first and second linings at any location about the ball is four layers or less.

32. The game ball of claim 1, wherein the first and second linings are arranged about the ball such that the collective layering of the first and second linings at any location about the ball is five layers or less.

* * * * *